US005566487A

United States Patent [19]

Vaid et al.

[11] Patent Number: 5,566,487

[45] Date of Patent: Oct. 22, 1996

[54] INTEGRAL BUTT PLATE WITH LATCH AND CATCH MECHANISMS FOR PISTOL MAGAZINE

[75] Inventors: Pardip K. Vaid, Northampton, Mass.; Philip H. Stevens, Skaneateles, N.Y.

[73] Assignee: Smith & Wesson Corp., Springfield, Mass.

[21] Appl. No.: 527,530

[22] Filed: Sep. 12, 1995

[51] Int. Cl.[6] ..... F41A 9/25; F41A 9/65

[52] U.S. Cl. ..... 42/7; 42/50

[58] Field of Search ..... 42/50, 7, 18, 22; 89/33.1, 34

[56] References Cited

U.S. PATENT DOCUMENTS

| | | | |
|---|---|---|---|
| 3,019,542 | 2/1962 | Manthos | 42/18 |
| 3,732,643 | 5/1973 | Wells | 42/50 |
| 3,803,739 | 4/1974 | Haines et al. | 42/50 |
| 4,155,187 | 5/1979 | Lichtman | 42/7 |
| 4,516,346 | 5/1985 | Farrar et al. | 42/50 |
| 5,437,118 | 8/1995 | Sniezak et al. | 42/7 |

*Primary Examiner*—Stephen M. Johnson

*Attorney, Agent, or Firm*—McCormick, Paulding & Huber

[57] ABSTRACT

Unitary polymeric butt plate with an integral latch and catch mechanism is used for a magazine of a semi-automatic pistol. A frame of the pistol includes a handgrip defined by a backstrap, a front strap and laterally spaced side walls and a downwardly opening magazine chamber within the handgrip. A downwardly open slot provided through opposed side wall portions of said frame, one portion of a catch disposed within said frame and interengageable with another portion of said catch mechanism. The latch mechanism is adapted to interlock with a slot through opposed wall portions adjacent the lower end of the magazine. The catch includes a pair of spaced, opposed and resiliently flexible arms extending upwardly and outwardly in divergent relation from opposite side portions of the butt plate portion. Each of the arms includes one portion of a catch mechanism adjacent its upper end which is adapted to interengage releasably with another portion of the catch located within a magazine chamber provided within the handgrip of the pistol so that upon insertion of the magazine into such chamber, the arms will be deflected inwardly with resultant interengagement of the two portions of the catch mechanism.

10 Claims, 2 Drawing Sheets

INTEGRAL BUTT PLATE WITH LATCH AND CATCH MECHANISMS FOR PISTOL MAGAZINE

FIELD OF THE INVENTION

This invention relates to semi-automatic handguns or pistols and, more particularly, to a magazine having an integral butt plate and catch mechanism for releasably securing a cartridge magazine within the grip of the handgun frame.

BACKGROUND OF THE INVENTION

It has been commonplace for many years to find discrete magazines adapted to receive and hold in stacked relation a plurality of cartridges to be fed into the chamber of a semi-automatic handgun, or pistol. Such magazines are generally secured, in a releasable manner, within a chamber provided in the grip portion of the frame. The magazine is releasably secured therein by a catch mechanism and may be released by actuation of a button to remove the magazine from the gun, such as after all of the cartridges have been fired. The magazine may then be reloaded, or replaced with a preloaded magazine, for insertion into the magazine chamber of the pistol.

Typically, such magazine catches comprises a spring-loaded release button which protrudes from the left side of the grip for right-handed shooters, or from both sides in some ambidextrous models, as disclosed in U.S. Pat. No. 4,899,476 assigned to the same assignee as this application. Such placement of the actuator or release button is important to enable the shooter to release the magazine from the pistol quickly using the thumb of the shooting hand after the last round has been fired. It is also important that the actuator be located or accessible to the shooter without requiring a substantial change, or release of one's grip on the pistol.

The major advantage of the disposition of the above discussed actuator is that persons with reasonable dexterity will be able to eject the empty magazine with the shooting hand, reinsert a preloaded magazine, using the non-shooting and resume firing relatively quickly and easily. Given that most shooters who are likely to require such manipulative skills include law enforcement officers, military personnel and firearms contestants, routinely carry one or more preloaded spare magazines and have the occasional practice session at the shooting range. It is no surprise to learn that such shooters are capable of executing a "mag shift" and be ready to resume firing in a matter of seconds.

A disadvantage associated with such conventional arrangements is that the placement of the catch release may be inconvenient for many users. Indeed, shooters having other than average size hands may not be able to operate the catch without repositioning the shooting hand on the grip. These users must, therefore, release their grip of the pistol and/or rotate their shooting hand relative to the pistol grip in order to manipulate the catch with their thumb. This manipulation is cumbersome and adds to the time during which the shooter is unable to fire the weapon. While minimizing such time loss may be important to a good score in competitive shooting, in law enforcement situations, if not overcome, it could pose a potentially deadly situation.

Another disadvantage of the prior art construction is that it comprises a number of discrete components, each of which require individual manufacture and subsequent assembly. In addition, a lateral bore must be provided in the frame for receiving the actuator button. As a result of these numerous operations, the cost of manufacture of such a multi-component construction is relatively high.

One type of magazine catch mechanism which, at least in part, attempts to remedy the aforementioned disadvantages is disclosed in U.S. Pat. No. 4,155,187. That patent discloses a magazine catch comprising a snap-type interlock in which a lower portion of each magazine side wall is punched out or cut to provide a tongue 36 which is knurled, or ribbed tab 38 at its free bottom end. The tabs are spaced outward of the walls of the magazine. Each tongue has straight bottom edges which are engageable with edges of cutouts disposed in the side walls 46 and 47 of the grip portion of the frame. Accordingly, when the magazine is inserted into the grip, the tongues are cammed inwardly by the inner surface of the side walls of the grip until the magazine is fully inserted, whereupon the edges of the tongue will spring outwardly to engage the edges of the cutouts and secure the magazine in-place in the gun. The magazine can be released by squeezing the tabs inwardly towards one another. An advantage to this construction is that the shooter is able to remove an empty magazine entirely with the non-shooting hand. The shooting hand can, therefore, remain generally in its firing grip on the gun during reloading.

Although the latter configuration offers advantages over the previously-referenced prior art, it is unfortunately not without its own disadvantages. In particular, foreign particles, such as dirt, mud or gravel may become lodged in the exposed gap between the free-ends of the tabs and the magazine tube and thereby prevent the user from depressing the tabs for removing the magazine for reloading. Dirty or muddy conditions are commonly encountered by military and law enforcement personnel in the field and as a result, the instances of weapon failure may be unacceptably high.

DISCLOSURE OF THE INVENTION

It is a principal object of this invention to provide a magazine catch for a handgun which is easily operable by handgun users regardless of their hand size.

It is an additional object of this invention to provide a magazine catch for a handgun, including a magazine release therefor which is, in part, a composite structure that is more reliably posed on the magazine.

It is an another object of this invention to provide a magazine catch which provides optimum performance on compact handguns.

It is a further object of this invention to provide a magazine catch which is less expensive to manufacture than magazine catches of the prior art while being highly reliable in its performance.

It is a still further object of this invention to provide a magazine catch which is less susceptible to failure due to particulate matter intrusion.

According to this invention, a unitary polymeric magazine butt plate component with a latch and a catch mechanism integral therewith is provided for releasably securing a cartridge magazine within a cavity in the handgrip of a semiautomatic pistol. The component assembly comprises a butt plate portion with a latch mechanism adapted to interlock the butt plate onto the lower end of a magazine tube and a pair of spaced, opposed and resiliently flexible arms extending upwardly and outwardly in divergent relation from opposite side portions of the butt plate portion. Each of the arms includes one portion of a catch mechanism adjacent its upper end which is adapted to interengage, releasably, with another portion of the catch located within a magazine chamber provided within the handgrip of the pistol so that, upon insertion the magazine into such chamber, the arms will be deflected inwardly with resultant interengagement of the two portions of the catch mechanism.

The above and other objects and advantages of this invention will be more readily apparent from a reading of the following description of an exemplary embodiment thereof taken in conjunction with the following drawings.

DETAILED DESCRIPTION OF THE PREFERRED EMBODIMENT

Figure 1:
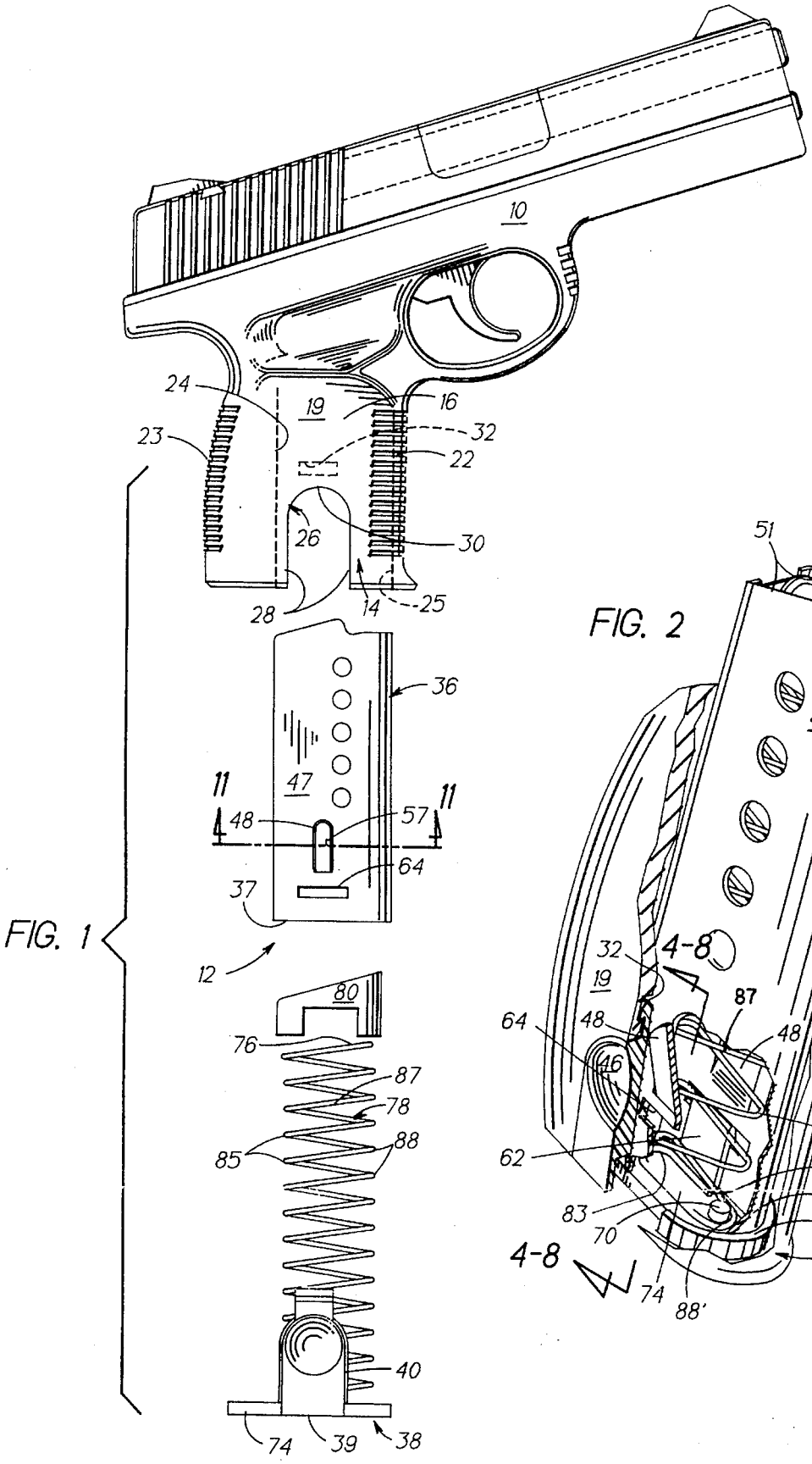
FIG. 1 is an exploded plan view of a handgun embodying the unitary magazine catch and butt plate assembly of the present invention.

Shown in FIG. 1 is a semi-automatic handgun or pistol having a polymeric frame 10 adapted to receive a cartridge magazine 12 in a chamber 14 disposed within the grip 16 thereof. The chamber 14 opens in a downward direction and is defined by inner surfaces 18 and 20 (FIG. 7) of side walls 19 and 21, the inner surface 25 of the front strap 22 and by rear wall 24 of the back strap 23. Each of the side walls and 21 of the hand grip 16 includes a downwardly opening slot 26 (FIG. 1) with generally parallel sides 28 extending from a radiused upper edge portion 30.

Figure 2:
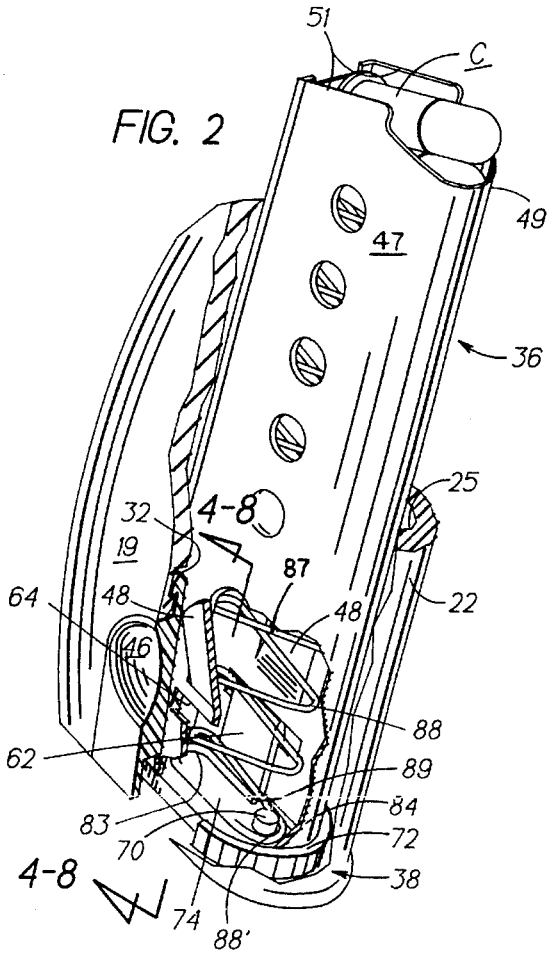
FIG. 2 is a perspective view, partly in section, on an enlarged scale, of the grip portion of the handgun with the magazine of FIG. 1 disposed therein.
Figure 7:
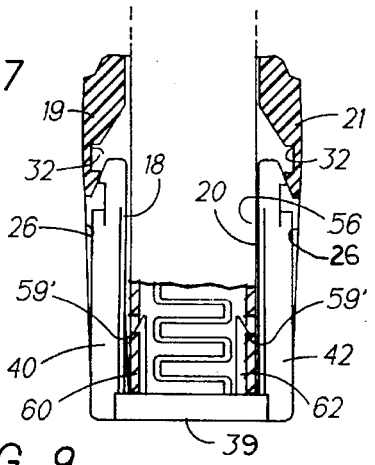
Figure 8:
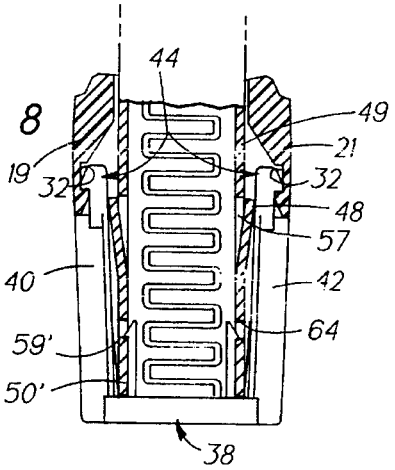

As shown in FIGS. 2, 7 and 8, and in phantom in FIG. 1, a cavity, or recess 32 is provided adjacent the arcuate, or radiused upper or inner edge portion 30 of each slot 26 and serves as one portion of the catch or detent mechanism of the catch mechanism embodying the invention. The cavities 32, as shown, are preferably of laterally elongated configuration with one disposed in each of the side walls 19 and 21 to serve as one portion of a catch or detent mechanism for releasably retaining the magazine in the chamber 14. The other portion of the detent, or catch is an outwardly extending nose-like projection 45 disposed adjacent the outer end of each arm portion 40 and 42 of a polymeric butt plate component that includes a catch and latch mechanism 38 (FIG. 3) adapted for latching the component onto the magazine 12.

As best shown in FIGS. 1 and 2, the magazine 12 comprises a stainless steel tube 36, a helical magazine spring 78, a cartridge follower 80 disposed on an upper end 76 of the spring 78. The spring 78 is preferably a coil, or helical type compression spring adapted to advance in succession each of a plurality of vertically stacked cartridges c to the uppermost position in the magazine. As depicted in FIG. 2, the upper cartridge is retained in the magazine by inturned lip portions 51 disposed along the upper edge portions of the side walls 47 and 49.

The spring 78 comprises a plurality of radiused loop portions 88, as shown in FIGS.1 and 2, with the opposite ends of each loop 88 being interconnected by rectilinear side portions 87 of opposite angular pitch to adjacent opposite loop portions 85. The lowermost, or terminal helical loop 88' (FIG. 2) of the magazine spring 78 comprises the final helically pitched loop portion followed by a parallel and coplanar terminal end loop portion 83 of the spring, shown in FIGS. 2 and 9, that includes the final rectilinear side portion 87 and the terminal end portion 89 disposed in planar orientation against an inner surface 74 of the butt plate 39.

Figure 11:
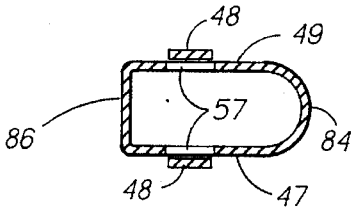
FIG. 11 is a view of the magazine tube taken along 11—11 of FIG. 1.

With the exception of its front arcuate wall 84, the magazine tube 36 is of a generally rectangular cross-section and, as shown in FIG. 11, comprises generally planar side walls 47 and 49 and rear wall 86. An opening, or cutout 64 is provided, as shown in FIGS. 1 and 4–8, at corresponding locations through each of the side walls 47 and 49 at a predetermined distance from the lower end 37 of the tube. In addition, a cantilever spring 48 is preferably formed by stamping out an elongated finger-shaped portion out of each side wall portion of the magazine. As shown in FIGS. 1 and 11, the cutout 57, formed by the stamping operation, remains connected to the finger only at its lower end and is free along its side edges and its outer edge. As illustrated in FIG. 1, the longitudinal axis of each finger-shaped spring 48 is centered approximately above each of the cutouts 64. The finger-shaped portions 48 may be die-cut, or stamped from the magazine walls such that they are simultaneously displaced outward at a predetermined angle relative to the plane of the magazine side walls 47 and 49 from a point of origin of each finger portion. Since the magazines are usually formed using 301 stainless steel, to improve the tensile strength and thus the resilience, or spring characteristics of the fingers 48, it is important that during the formation of the fingers 48 that they be coined or cold worked sufficiently such that they will be capable of spring action.

Having established their capacity to perform as cantilever backup springs, the importance of integral metallic backup springs 48 stamped from the magazine walls, is improved performance and extended operating life of the polymeric catch mechanism. The cantilever springs 48 also ensure more reliable and positive operation under a variety of adverse ambient conditions. The spring 48 and cutout 64 cooperate with the integral, polymeric butt plate 39 and catch mechanism 38 when disposed in assembled relation on the magazine. The relationship of the spring 48 is illustrated best by reference to FIGS. 2 and 8, where it will be noted that the spring fingers 48 are substantially shorter than the length of the outer arms 40 and 42 so that it will have a greater degree of stiffness than a longer spring which otherwise has the same parameters. It will also be noted that the upper edge of the spring 48 is engaged with smooth inner surfaces at the outer arms 40 and 42 at a point slightly below its chin surface 59. It will be realized that the springs 48 should pose no impediment to latching the butt plate component onto the magazine, but will assist in operation of the catch mechanism.

Figure 3:
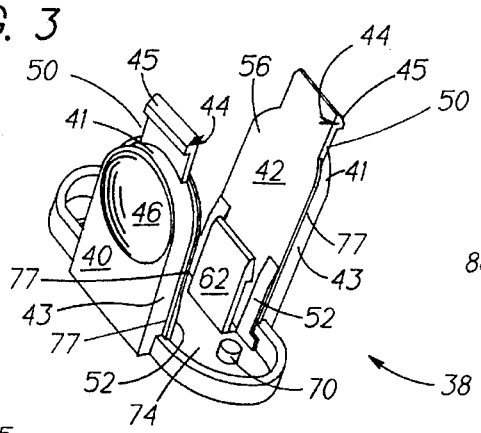
FIG. 3 is a perspective view of the unitary magazine catch and butt plate assembly of FIG. 2.

As best shown in FIG. 3, a combination butt plate with latch and catch mechanisms 38 is formed by injection molding that tri-functional component as an integral component of a polymeric material such as Nylon or Delrin P100® manufactured by Dupont®. This material is a high viscosity, highly crystalline acetal polymer which is sufficiently resilient and has excellent structural, or tensile strength. Therefore, even though subjected to repeated deformations, the catch arms will have a very low fatigue, or failure rates attributable to plastic creep. In general, the Delrin is well suited to injection molding of fairly sophisticated unitary parts with low failure rates. The molded tri-functional component 38 comprises the butt plate portion 39 and two pairs of upwardly extending resilient arms, including outer arms 40 and 42 which are the major portion of the catch mechanism and a pair of shorter arms 60 and 62 which are the major portions of the latch mechanism.

Figure 9:
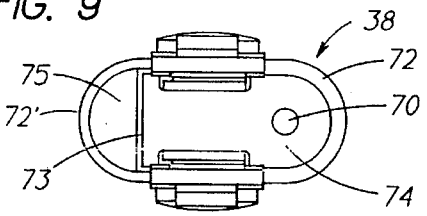
FIG. 9 is a top plan view of the butt plate of FIG. 3.
Figure 10:
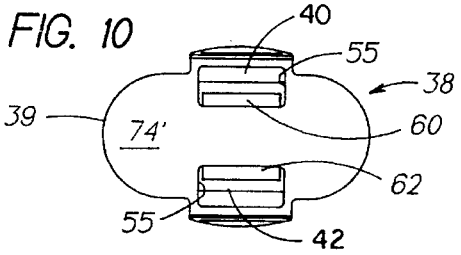
FIG. 10 is a bottom plan view of the butt plate of FIG. 9.

Referring now to FIGS. 1 and 9, the butt plate 39 comprises a bottom wall 74 wherein its lower surface 74', as shown in FIG. 10, is generally planar, except for slots 55 opening therethrough to facilitate the removal from the mold used in the manufacture of the integral butt plate with the latch and catch mechanisms. The upper surface of the plate 39 is defined by a peripheral rim portion 72 at its forward end, a rear portion 75 defined by a rectilinear transverse wall 73 and a semicircular rim portion 72'. The rear portion is adapted to interfit within and close "off" a downwardly opening void defined by the inner surface of the back strap 23 and the rear wall 24 of the magazine chamber. The butt plate 39, at its forward end, comprises a peripheral rim 72 and an upstanding cylindrical lug 70 which serves to anchor the last helical convolution 88' and the planar terminal portions of the magazine spring 78 in a centralized location on the inner surface 74 of the butt plate 39. With this construction, the spring 78 will not interfere with the assembly of the magazine 36 and the butt plate 39 portion of the latch/catch mechanism. The front rim 72 and back rim 72' are dimensioned in height, including their inner and outer radii of curvature, so that the butt plate 39 will fit closely into the openings provided therefor and with the lower surface 74' generally flush with the adjacent lower surfaces of the frame.

Figure 4:
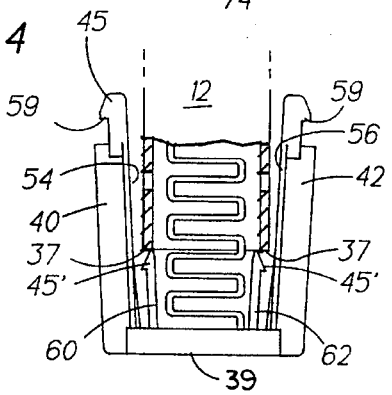
FIGS. 4–8 are cross-sectional views taken along 4–8 of FIG. 2, showing the sequence of steps for latching the butt plate to the magazine and of then inserting the latched assembly into the magazine chamber using the catch mechanism.
Figure 5:
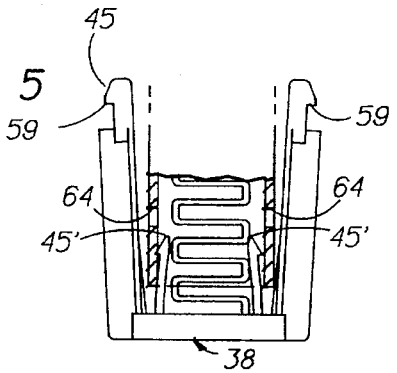
Figure 6:
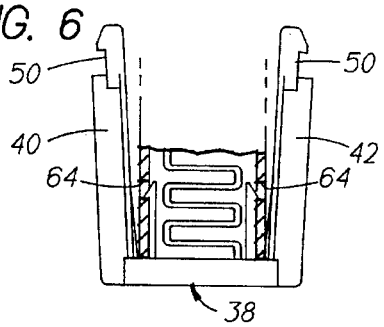

The outer arms 40 and 42 extend upwardly in divergent angular relation from opposed side edge portions of the butt plate 39 when in their normal untensioned relationship, which can best be seen in FIGS. 4–6, with the outer arms diverging outwardly to their maximum extent. The inner surfaces 54 and 56 of the outer arms are generally planar and extend slightly beyond the side edges 43 and upper arcuate surfaces 41 to form a peripheral flange 77. When the magazine 12 is inserted into the gun cavity 14, as can best be seen in FIGS. 7 and slid upwardly into the slots 26, it will be noted that the outer arms are squeezed together to an approximately parallel relationship and, in that condition, are tensioned to spring outwardly. Indeed, as shown in FIG. 8, wherein the arms 40 and 42 are moved upwardly until the projections 45 thereon are aligned with the recesses 32, at which point the tension in the outer arms will result in the projections snap-fitting into the recesses 32. It should also be noted that the arms are only under slightly greater tension when in their secured position in the magazine chamber than in their untensioned condition.

The inner surfaces 54 and 56 of the outer arms being generally planar and extending slightly beyond the side edges 43 and the upper arcuate surfaces 41, thereby form a flange 77. The flange is adapted to engage the edge of inner surfaces 18 and 20 (FIG. 7) of the frame about the periphery of the slots 26 to effectively seal any gap therebetween. The flange 77 thereby prevents foreign matter, such as sand and grit, from entering the magazine chamber and interfering with the operation of the pistol.

As best shown in FIG. 3, the outer arms are reinforced by thickened bar or leg portions 52 disposed lengthwise along each side edge portions of the inner surfaces 54 and 56 of the arms adjacent edges 43 thereof. The leg sections extend from the butt plate 39 upwardly, approximately one-third the height of the arms. The sections are of the same width over their full length while being thicker at their lower ends and gradually taper down toward their upper ends where the sections blend, or fare with the inner surfaces of arms. It is postulated that the thicker, lower portions of the arms 40 and 42 are important in that, as a result thereof, the arms of the catch mechanism have the requisite parameters of flexural response versus arm stiffness, durability and service life.

The outer surfaces of the arms 40 and 42 are more contoured than the inner surfaces and comprise straight side edge portions 43 which fare into a radiused upper edge 41 portion, as best shown in FIG. 3. A circular portion 46 of concave contour is disposed on the outer surface of each of the arms and is concentric in relation to the radiused edges 41 thereof. The concave portions of the outer arms are adapted to be readily grasped by the pincer fingers to operate the catch mechanism by squeezing the arms 40 and 42 inwardly.

Each of the arms 40 and 42 include a catch portion 44 which extends upwardly of the upper inner edge portion of the arcuate surfaces 41 of each arm. Each of the catches 44 comprises a beveled, or convexly curved upper surface 45 disposed on the outer end portion of a planar shank portion 50 of a predetermined height and a downwardly facing chin portion 59. The shank 50 is of a height such that when the butt plate member is fitted into the magazine of the pistol, each of the catch members 44 will snap-fit into each of the cavities 32. The dimensions of the arms, including the radius of curvature of the edge 41 and the distance between edges 43, are such as to enable the arms slidably to interfit within the slot 26 of the frame, as shown in FIG. 2.

Each of the shorter latch arms 60 and 62 essentially replicates the catch members 44 in that they also comprise a shank portion 50' that extends upwardly of the inner surface 74 of the butt plate, an upper cam portion 45' of convex or beveled configuration and a chin portion 59'. The only significant and notable differences is that the latch mechanism is adapted to interengage the cutouts 64 in the magazine walls to thereby interlock permanently with the magazine and that these arms are somewhat thinner. Accordingly, the inner arms 60 and 62 are adapted to interlock with or latch onto the magazine 12 and, once latched, a specialized tool would likely be required to disassemble the butt plate from the magazine without risk of damage to one of the components thereof. Thereafter, with the butt plate so mounted, the magazine can be used in much the same manner as a conventional magazine except for using the thumb and forefinger to release the magazine from its chamber.

In their relaxed, or untensioned condition, as best shown in FIGS. 4–6, the arms 40 and 42 diverge slightly from each other. The divergence is such as to require the arms to be pressed inwardly to an almost parallel relationship, as shown in FIG. 7, as they are inserted and moved upwardly into the cavities 32. The arms 40 and 42 are therefore substantially tensioned and moved inwardly to a point at which the chin 59 of the arms is moved beyond the lower edges of the cavities 32. At that point, the arms will snap outwardly and thereby will be releasably secured in the chamber 14. It is an important feature of the magazine catch construction of this invention that when the outer arms are fully engaged with the cavities 32, there is only slightly more tension in the arms than in their wholly untensioned condition. As a result, any loss of resilience of the injection molded polymer arms caused by the phenomenon called plastic "memory" or "creep" will be slight and it is unlikely that the loss of resilience would result in any malfunctioning, or failure of the catch mechanism, particularly in view of the backup function of the metal cantilever spring.

As shown in FIGS. 1 and 2, the magazine 12 is assembled by inserting the upper end 76 of the spring 78, including a cartridge follower 80 disposed thereon, into the lower end 37 of the magazine tube 36. Once the spring has been inserted, the lower end 88' thereof is seated on the upper surface 74 of the butt plate 39 between the inner arms 60 and 62, with the final helical loop 88' disposed generally concentrically about the lug 70. The upper edge portions of the inner arms are then aligned to fit into the lower end of the magazine tube 36 and between the side walls thereof and the two pans are then pressed together until the chin 59' of the inner arms snap into latched interengagement with cutouts 64 in the side walls of the magazine. Once the inner arms are so engaged, the magazine assembly has been completed.

The magazine may thereafter be loaded, in a conventional manner, with ammunition and inserted into the magazine chamber of the pistol frame 10. Upon insertion, the cam surfaces 45 of the arms 40 and 42 will engage the radiused upper edge portions 30 of the frame walls 19 and 21 and thereby deflect the arms inwardly toward one another against their normal divergent bias, as shown in FIGS. 4–6. As the magazine is inserted further, the latching members will slide along the inner surfaces of the rear wall 24. As the magazine is fully inserted, as shown in FIG. 8, the outward, or divergent bias of the arms will cause the projections 44 to snap-fit into the recesses 32 to secure the magazine within the frame 10. The pistol is thus ready for firing.

When all the ammunition has been emptied from the magazine, it can be removed from the frame simply by depressing the concave portions 46 of the arms 40 and 42 with the thumb and forefinger of the non-shooting hand. This action will release the catch members 32 and 44 from one another, enabling the user to slide the magazine downwardly out of the frame for reloading.

An advantage of this configuration is that regardless of the hand size of the user, removal and reinsertion of the magazine from the pistol can be accomplished entirely with the non-shooting hand. While individual shooters may need to open their grip sufficiently in the region of the lower two fingers thereof to provide access for the pincer fingers to operate the catch release arms, it has been found that he or she can continue to maintain a firm and controlling grip with the remainder of the shooting hand. Generally, shooters of even limited experience will be able to hold a pistol of the type embodying this invention by using the thumb, forefinger and metacarpal portion of the shooting hand. As a result, reloading sequences can be accomplished without any significant dislocation of the shooting grip.

Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described my invention, what is claimed is:

1. In a semi-automatic pistol having a frame with a handgrip defining a backstrap, a front strap and laterally spaced side walls and a downwardly opening chamber within the handgrip adapted to receive a magazine therein, the improvement comprising downwardly open slots provided in spaced opposed relation through both side walls of said frame, each of said slots including side edge portions disposed in generally parallel coplanar relation with the side edge portions in the other of said slots, a first portion of a catch mechanism disposed within said frame, a unitary polymeric magazine butt plate with an integral pair of resiliently flexible arms extending upwardly of the butt plate and in divergent angular relationship, said arms being dimensioned to interfit slidably within said slots to thereby reduce said divergent relationship of said arms while substantially tensioning said arms to resume their divergent condition and a second portion of said catch mechanism disposed on at least one of said arms for interengagement with said first portion in said frame when the magazine is fully inserted into said chamber for releasably retaining the magazine in place in said chamber, said arms including outer surface portions exposed between the edge portions of said slots adapted to be squeezed together to disengage the portions of said catch mechanism to enable withdrawal of the arms from said slots and the magazine from said chamber.

2. In a semi-automatic pistol, as set forth in claim 1, and in which the frame of said pistol is a unitary polymeric material, said unitary butt plate further includes a latch mechanism comprising at least one other upwardly extending arm disposed inwardly of the catch mechanism, said other arm being substantially shorter in height and of lesser flexibility than the arms forming said catch mechanism, said magazine having a slot disposed through a wall portion thereof adapted for interlocking engagement with a portion of said other arm for locking said butt plate onto said magazine.

3. In a semi-automatic pistol, as set forth in claim 1, and in which each of the arms further includes a lower portion of substantially greater width and thickness than an upper portion of increased flexibility.

4. In a semi-automatic pistol, as set forth in claim 3, and in which said upper portion of each arm includes at its upper end, a shank portion with an outwardly extending projection forming said portion of said catch mechanism and in which said first portion comprises a recess within the magazine chamber in said frame.

5. In a semi-automatic pistol, as set forth in claim 1, and in which the magazine having a wall portion formed of sheet steel is stamped to form an elongated finger portion which outwardly extends at an acute angle to engage the inner surface of at least one of said arms to enhance the spring action of and to increase the operating life of said catch mechanism.

6. In a semi-automatic pistol, as set forth in claim 1, and in which said butt plate comprises an integral polymeric component comprising a butt plate portion having a lug that extends upwardly from an inner surface thereof to engage with a loop portion of a magazine spring to hold the lower end of said spring from interfering with assembly of the magazine.

7. In a semi-automatic pistol, as set forth in claim 1, and in which said second portion of said catch mechanism has an outwardly projecting detent portion engageable with said first portion of said catch mechanism comprising a recess adapted to receive said detent portion therein.

8. In a semi-automatic pistol, as set forth in claim 1, and in which said unitary butt plate further includes a latch mechanism comprising a pair of upwardly extending latch arms disposed inwardly and being shorter in height than the pair of arms that comprise the catch mechanism, a first portion of said latch mechanism disposed within the magazine, and a second portion of said latch mechanism disposed on at least one latch arm for interengagement with said first portion of said latch mechanism to interlock said butt plate onto the magazine.

9. In a semi-automatic pistol, as set forth in claim 8, and in which said second portion of said latch mechanism comprises a shank portion with an outwardly extending projection for engaging the first portion of said latch mechanism.

10. In a semi-automatic pistol, as set forth in claim 8, and in which said first portion of said latch mechanism comprises a slot disposed through a wall portion of said magazine adapted for interlocking with said second portion of said latch mechanism.

* * * * *

UNITED STATES PATENT AND TRADEMARK OFFICE

CERTIFICATE OF CORRECTION

PATENT NO. : 5,566,487

DATED : October 22, 1996

INVENTOR(S) : Pardip K. Vaid and Philip H. Stevens

It is certified that error appears in the above-identified patent and that said Letters Patent is hereby corrected as shown below:

In column 8, line 36, before "portion", insert ---second---.

Signed and Sealed this

Twenty-fifth Day of February, 1997

Bruce Lehman

*Attest:*

BRUCE LEHMAN

*Attesting Officer*

*Commissioner of Patents and Trademarks*